United States Patent [19]

Naito et al.

[11] 4,033,649

[45] July 5, 1977

[54] ELECTRICALLY-OPERATED SHIFTABLE ARTICLE STORAGE DEVICE

[75] Inventors: Hanichiro Naito; Tsuneo Yamaguchi, both of Tokyo, Japan

[73] Assignee: Elecompack Company Limited, Tokyo, Japan

[22] Filed: Mar. 31, 1975

[21] Appl. No.: 563,838

[30] Foreign Application Priority Data

Apr. 2, 1974 Japan ..... 49-37174
Dec. 27, 1974 Japan ..... 50-148665

[52] U.S. Cl. ..... 312/201; 312/199; 312/198; 214/16 B

[51] Int. Cl.[2] ..... A47B 53/00; B65G 47/00

[58] Field of Search ..... 312/201, 198, 199; 214/16 B

[56] References Cited

UNITED STATES PATENTS

| | | | |
|---|---|---|---|
| 2,654,489 | 10/1953 | Ingold | 312/199 |
| 2,706,573 | 4/1955 | Ingold | 312/199 |
| 2,802,582 | 8/1957 | Isven | 312/199 |
| 3,366,430 | 1/1968 | Diedrich | 312/201 |
| 3,597,034 | 8/1971 | Wetzler | 312/199 |
| 3,615,122 | 10/1971 | Naito et al. | 312/199 |
| 3,640,595 | 2/1972 | Staller et al. | 312/198 |
| 3,829,189 | 8/1974 | Staller | 312/198 |
| 3,865,446 | 2/1975 | Mastronardi | 312/201 |
| 3,890,903 | 6/1975 | Showell | 312/198 |

FOREIGN PATENTS OR APPLICATIONS

| | | | |
|---|---|---|---|
| 222,834 | 1/1962 | Austria | 312/201 |
| 1,214,028 | 11/1970 | United Kingdom | 312/201 |

*Primary Examiner*—Paul R. Gilliam
*Assistant Examiner*—Victor N. Sakran
*Attorney, Agent, or Firm*—Richard L. Cannaday; William J. Unqvarsky; Francis C. Hand

[57] ABSTRACT

An electrically-operated shiftable article storage device in which a plurality of shiftable article storage units adapted for movement in a direction normal to the article storage faces thereof to form a plurality of article handling aisles therebetween are normally arranged closely adjacent to each other to leave a limited space corresponding to at least one article handling aisle, and at least one of the article storage units is moved in either direction to form said article handling aisle opposite to the article storage face of a desired one of said article storage units so that articles can be handled in said article handling aisle. In the device, a confirmation switch is disposed for each article handling aisle at a position at which the state of the corresponding article handling aisle can be readily confirmed, so that the article storage units cannot be moved unless the confirmation switch associated with an already existing aisle is actuated before causing shifting movement of one or more of the article storage units to form a new article handling aisle.

15 Claims, 12 Drawing Figures

ELECTRICALLY-OPERATED SHIFTABLE ARTICLE STORAGE DEVICE

This invention relates to a shiftable article storage device in which a plurality of shiftable article storage units are normally arranged in close proximity to each other without any interval therebetween when access to anyone of the article storage units is not required, and at least one of these article storage units is moved to form an article handling aisle between a desired one of the article storage units and the adjacent article storage unit to permit handling of articles in the article handling aisle thus formed.

An electrically-operated shiftable article storage device is commonly known in which a plurality of shiftable article storage units adapted for movement in a direction normal to the article storage faces thereof are normally arranged closely adjacent to each other over the substantial area of narrow space except for a limited area corresponding to at least one aisle to be formed between adjacent ones of these article storage units, in order that a large number of such article storage units can be accommodated in the narrow space. These shiftable article storage units are driven by electric motors when access to a desired one of them is required so that an article handling aisle can be formed opposite to the article storage face of the desired article storage unit to permit handling of articles in the aisle thus formed.

In such a known shiftable article storage device, it is necessary to close an already existing aisle in order to form a new aisle. Therefore, when obstacles such as an article handler or an article or articles are present in the existing aisle, a dangerous situation may occur in which these obstacles are caught between or crushed by the article storage units moving toward each other. In an effort to avoid such a danger, an obstacle detector is provided on each of the article storage units at each side facing the article handling aisle so that shifting movement of the article storage unit toward the adjacent one can be immediately stopped in response to the detection of an obstacle by the obstacle detector. However, the obstacle detector may not engage with obstacles depending on the shape of the obstacles. In such a case, the article storage unit moving toward the adjacent one would not be automatically stopped even when such obstacles are caught between the article storage units, resulting in such a danger that both the obstacles and the article storage units may be impaired or destroyed.

It is therefore a primary object of the present invention to provide an electrically-operated shiftable article storage device in which a plurality of shiftable article storage units adapted for movement in a direction normal to the article storage faces thereof to form a plurality of article handling aisles therebetween are normally arranged closely adjacent to each other to leave a limited space corresponding to at least one article handling aisle, and at least one of said article storage units is moved in either direction to form said article handling aisle opposite to the article storage face of a desired one of said article storage units so that articles can be handled in said article handling aisle, said article storage device comprising a reversible drive motor mounted on each said article storage unit for causing shifting movement thereof, control switch means disposed on each said article storage unit for selectively rotating said drive motor in the normal and reverse directions, regulating means disposed on at least one of the adjacent article storage units forming each individual article handling aisle between the article storage faces thereof facing each other on opposite sides of said article handling aisle so as to detect shifting movement of one of said adjacent article storage units toward and away from the other thereby regulating the relative shifting movement of said adjacent article storage units, and confirmation switch means disposed for each said article handling aisle at a position at which the state of said article handling aisle can be readily confirmed, whereby shifting movement of one or more of said article storage units to form a new article handling aisle is permitted only when said confirmation switch means associated with an already existing article handling aisle is actuated.

Thus, in the electricaly-operated shiftable article storage device according to the present invention, the shiftable article storage units cannot be moved in either direction unless the confirmation switch means are actuated, and the specific confirmation switch means associated with the already existing aisle must be actuated before the shiftable article storage unit or units are moved to form a new aisle. Therefore, the state of the already existing aisle can necessarily be visually confirmed by the eyes of an article handler before such new aisle is formed, and this new aisle can be safely formed without the danger of the kind pointed out hereinbefore.

Another object of the present invention is to provide an electrically-operated shiftable article storage device of the above character further comprising a timer circuit which operates in response to the actuation of the confirmation switch means and acts to energize an automatic cut-off circuit for automatically disconnecting the motor circuit from a control power supply upon termination of a predetermined time setting when the control switch means is not actuated or fails to operate within this predetermined time setting.

This timer circuit is provided so that the shiftable article storage units cannot make shifting movement unless the control switch means is actuated immediately after actuation of the confirmation switch means. Therefore, the desired safety can be ensured due to the fact that the article storage units are not maintained ready to move over an indefinite period of time after the actuation of the confirmation switch means.

Other objects, features and advantages of the present invention will be apparent from the following detailed description of preferred embodiments thereof taken in conjunction with the accompanying drawings, in which.

Figure 1:
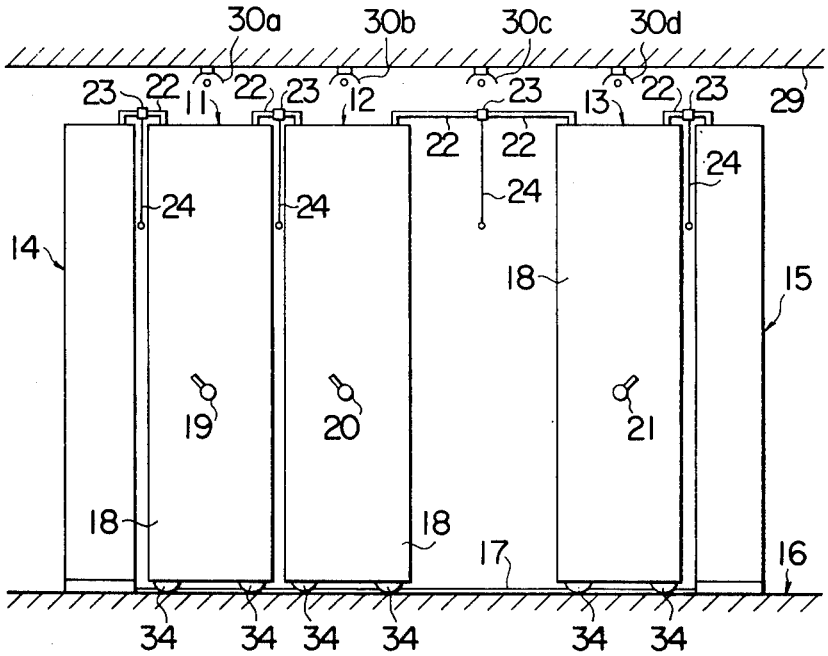
FIG. 1 is a front elevational view of a first embodiment of the shiftable article storage device according to the present invention.

FIGS. 1 to 4 show a first embodiment of the electrically-operated shiftable article storage device according to the present invention. Referring to FIG. 1, three shiftable stack units 11, 12 and 13 are shown disposed between a pair of stationary stack units 14 and 15 in a room. Each of these stack units 11 to 15 has a top wall, a bottom wall and at least two side walls. The shiftable stack units 11, 12 and 13 are arranged to move toward the left and right in FIG. 1 on a plurality of guide rails 17 which are disposed in suitably spaced apart relation on a floor 16 to extend in a direction normal to article storage faces of the shiftable stack units 11, 12 and 13. A central partition extends across each of these shiftable stack units 11 to 13 in a direction transverse to the moving direction of the shiftable stack units 11 to 13 to provide a pair of article storage faces. The stationary stack units 14 and 15 have a single article storage face opposite to the corresponding article storage faces of the shiftable stack units 11 and 13. In FIG. 1, an article handling aisle is shown formed between the shiftable stack units 12 and 13 so that articles can be stored in these stack units or stored articles can be taken out of these stack units in this aisle.

The shiftable stack units 11, 12 and 13 are provided on the side wall 18 thereof with shift actuating switches 19, 20 and 21 respectively which are actuated when the leftward or rightward movement of the individual shiftable stack units is desired. These shift actuating switches 19, 20 and 21 are each in the form of a lever switch having a lever which can be swung toward a leftmost or rightmost position from a neutral position and can be locked in one of these three positions. These lever switches 19, 20 and 21 are of the double-pole double-throw type and thus have a pair of interlocking movable contacts and a pair of stationary contacts.

Figure 2:
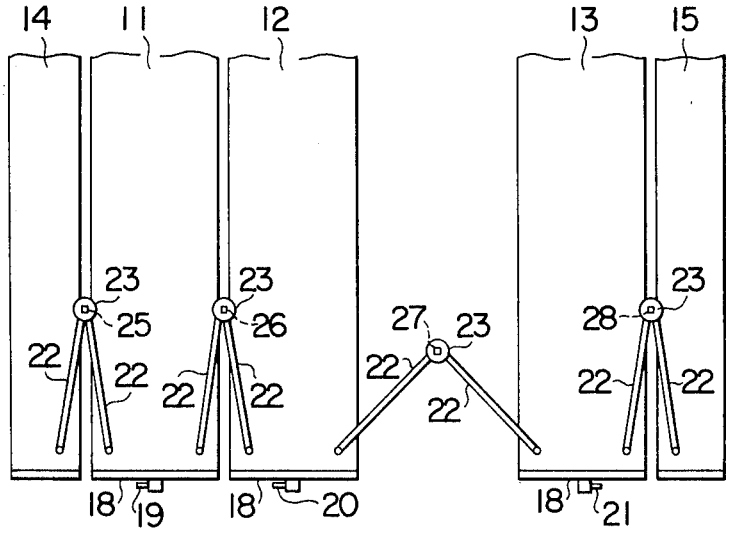
FIG. 2 is a partial plan view of the shiftable article storage device shown in FIG. 1.

As best shown in FIG. 2, swinging arms 22 are horizontally swingably pivoted at one end thereof to a point adjacent to one end edge of the top wall of the stationary stack units 14 and 15 and to spaced points adjacent to opposite end edges of the top wall of the shiftable stack units 11, 12 and 13. The left-hand swinging arm 22 pivoted to the shiftable stack unit 11 is hinge-connected at the other or free end thereof by a hinge 23 to the other or free end of the swinging arm 22 pivoted to the stationary stack unit 14. Similar hinge connections 23 are provided between the right-hand swinging arm 22 pivoted to the shiftable stack unit 11 and the left-hand swinging arm 22 pivoted to the shiftable stack unit 12, between the right-hand swinging arm 22 pivoted to the shiftable stack unit 12 and the left-hand swinging arm 22 pivoted to the shiftable stack unit 13, and between the right-hand swinging arm 22 pivoted to the shiftable stack unit 13 and the swinging arm 22 pivoted to the stationary stack unit 15. A pull switch 25 is mounted on the hinge connection 23 between the stationary and shiftable stack units 14 and 11. This pull switch 25 is such that it is turned on when a cord 24 is pulled and turned off when the hand gripping the cord 24 is released. Similar pull switches 26, 27 and 28 are mounted on the hinge connections 23 between the shiftable stack units 11 and 12, between the shiftable stack units 12 and 13, and between the shiftable and stationary stack units 13 and 15. These pull switches 25, 26, 27, 28 act as confirmation switch means as described hereinafter. In FIGS. 1 and 2, an article handler cannot make access to the cords 24 of the pull switches 25, 26 and 28 since the associated stack units are brought in close proximity to each other, but he can enter the aisle formed between the shiftable stack units 12 and 13 and can thus make access to the cord 24 of the pull switch 27. He can also look into the aisle to confirm the state of the aisle.

Illumination lamps **30*a* to 30*d* are fixed to the ceiling 29** of the room to illuminate the aisles formed between the shiftable stack units and between the shiftable stack units and the associated stationary stack units.

Figure 3:
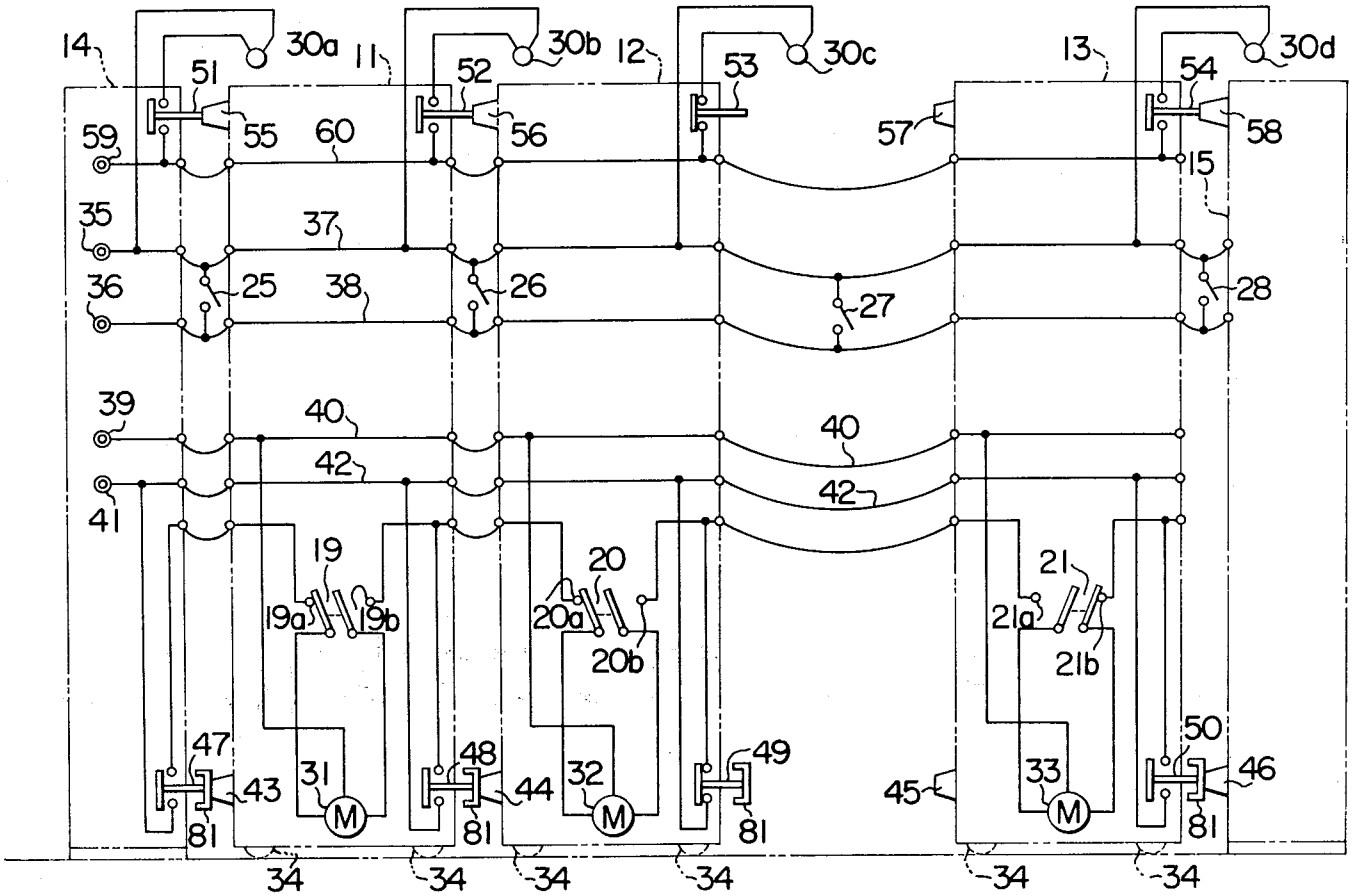
FIG. 3 shows a control mechanism for the first embodiment of the present invention.

Reversible drive motors 31, 32 and 33 are mounted in the shiftable stack units 11, 12 and 13 respectively as shown in FIG. 3. The driving force generated by the drive motor in each shiftable stack unit is transmitted to at least one driving roller 34 through a suitable reduction gear unit (not shown) so as to cause the shifting movement of the shiftable stack unit. The stationary stack unit 14 and shiftable stack units 11, 12, 13, are provided at a lower part thereof with limit switches 47, 48, 49 and 50 respectively. These limit switches 47, 48, 49 and 50 are engageable with lugs 43, 44, 45 and 46 provided on a corresponding lower part of the shiftable stack units 11, 12, 13 and stationary stack unit 15 respectively. These limit switches 47 to 50 are turned off when engaged by the respective lugs 43 to 46 and turned on when disengaged from the respective lugs 43 to 46.

Means for controlling the shiftable movement of the shiftable stack units and means for energizing the illumination lamps will be described with reference to FIG. 3. The pull switches 25, 26, 27 and 28 are connected in parallel with each other between a pair of conductors 37 and 38 connected to a pair of terminals 35 and 36. The reversible drive motors 31, 32 and 33 are connected at the common terminal thereof to another conductor 40 connected to another terminal 39. The limit switches 47 to 50 are connected at one terminal thereof to another conductor 42 connected to another terminal 41. The limit switch 47 is connected at the other terminal thereof to one stationary contact 19a of the lever switch 19 which is of the double-pole double-throw type, and the limit switch 48 is connected at the other terminal thereof to the other stationary contact **19*b* of the lever switch 19 and to one stationary contact 20*a* of the lever switch 20 of the same type. The limit switch 49 is connected at the other terminal thereof to the other stationary contact 20*b* of the lever switch 20 and to one stationary contact 21*a* of the lever switch 21 of the same type, and the limit switch 50 is connected at the other terminal thereof to the other stationary contact 21*b* of the lever switch 21. One of the movable contacts of the switch 19 associated with the stationary contact 19*a* is connected to the reverse rotation terminal of the drive motor 31, while the other movable contact thereof associated with the stationary contact 19*a* is connected to the normal rotation terminal of the drive motor 31. One of the movable contacts of the switch 20 associated with the stationary contact 20*a*** is connected to the reverse rotation terminal of the drive motor 32, while the other movable contact thereof associated with the stationary contact 20*b* is connected to the normal rotation terminal of the drive motor 32. One of the movable contacts of the switch 21 associated with the stationary contact 21*a* is connected to the reverse rotation terminal of the drive motor 33, while the other movable contact thereof associated with the stationary contact 21b is connected to the normal rotation terminal of the drive 33.

Limit switches 51, 52, 53 and 54 having a structure similar to that of the limit switches 47 to 50 are mounted on an upper part of the stationary stack unit 14 and shiftable stack units 11, 12 and 13 respectively for detecting whether the associated aisles are formed or not. Lugs 55, 56, 57 and 58 are provided on a corresponding upper part of the shiftable stack units 11, 12, 13 and stationary stack unit 15 respectively to engage with the respective limit switches 51, 52, 53 and 54 when the associated aisles are closed. These limit switches 51, 52, 53 and 54 are connected together with the respective illumination lamps 30*a*, 30*b*, 30*c* and 30*d* between the conductor 37 connected to the terminal 35 and another conductor 60 connected to another terminal 59.

The limit switches 47 to 50 are each provided in a plural number. For example, a plurality of limited switches 47 are mounted in suitable horizontally spaced apart relation on the stationary stack unit 14 at the side opposite to the confronting side of the shiftable stack unit 11. The remaining limit switches 48, 49 and 50 are similarly mounted on the respective stack units 11, 12 and 13. A horizontal bar 81 is fixed to the exposed portions of each set of the limit switches 47 to 50. These bars 81 are provided so that, when an obstacle is present in one of the aisles being closed by the movement of one of the shiftable stack units, the corresponding bar 81 is urged by the obstacle to turn off the associated limit switch before this limit switch is engaged by the associated lug, and the motor driving the shiftable stack unit can be stopped before the aisle is completely closed.

Figure 4:
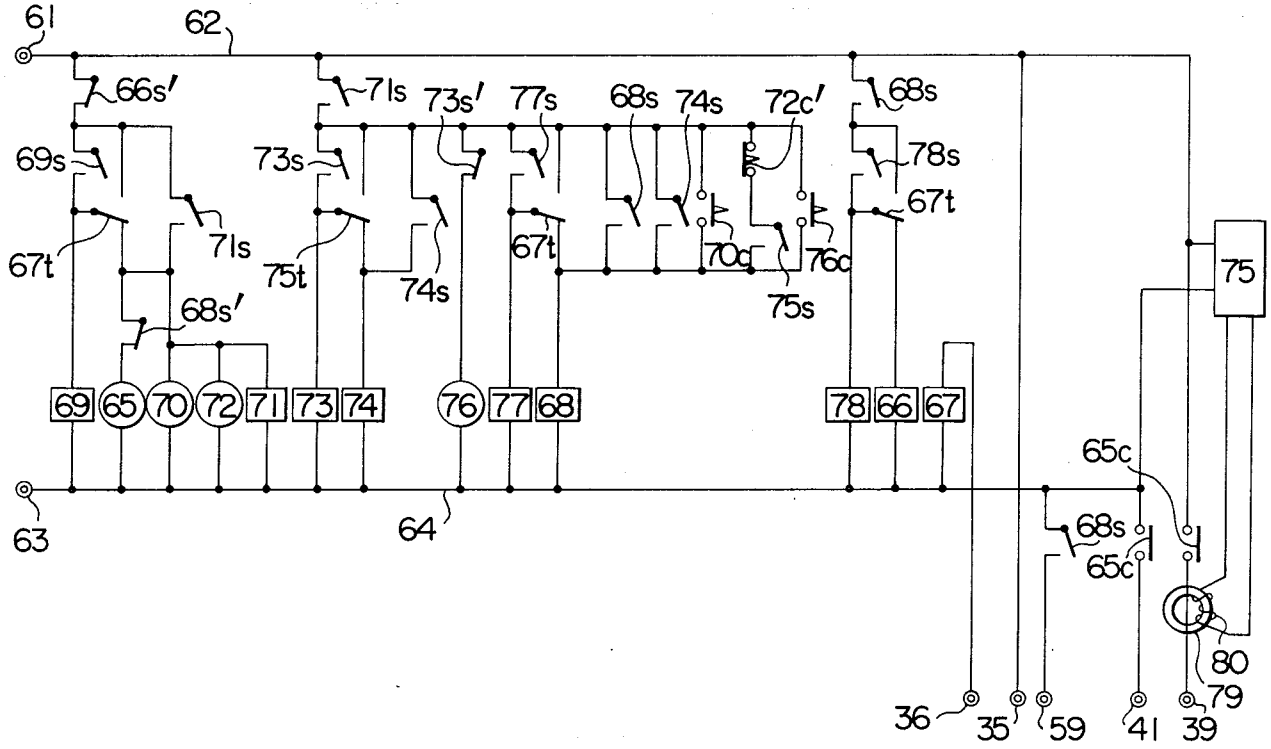
FIG. 4 shows a control circuit for the first embodiment of the present invention.

FIG. 4 shows a control circuit for the article storage device shown in FIGS. 1 to 3. Referring to FIG. 4, a conductor 62 is connected to a terminal 61 connected at one terminal of a power source, or supply and another conductor 64 is connected to another terminal 63 connected to the other terminal of the power source. An electromagntic switch 65 is provided for the on-off of electric power supplied to the motors 31, 32 and 33. This electromagnetic switch 65 is connected between the conductors 62 and 64 through a break contact 66*s'* of a resetting relay 66, a make contact 69*s* of an auxiliary relay 69 for the electromagnetic switch 65, a transfer contact 67*t* of a switch on-off detecting relay 67 detecting the on-off of the pull switches 25 to 28, and a break contact 68*s'* of a locking relay 68 for the electromagnetic switch 65. The auxiliary relay 69 for the electromagnetic switch 65 is connected through the transfer contact 67*t* of the switch on-off detecting relay 67 between the conductor 64 and the connection point of the break contact 66*s'* of the resetting relay 66 and the make contact 69*s* of the auxiliary relay 69. A timer 70 for setting the duration of power supply to the motors 31, 32 and 33 is also connected through a make contact 71*s* of a relay 71 between the conductor 64 and the connection point of the break contact 66*s'* of the relay 66 and the make contact 69*s* of the relay 69. This relay 71 is a memory relay which memorizes the fact that power is supplied to the motor circuit. The timer 70 is previously set to operate for a period of time which is equal to the longest period of time required for the formation of the aisles by the shifting movement of the shiftable stack units 11, 12 and 13. A make contact 70*c* of this timer 70 is closed when the timer 70 counts up the time setting specified above. Another timer 72 for determining the shift commencement timing of the shiftable stack units 11, 12 and 13 is connected in parallel with the timer 70 and relay 71. The movable contact of the transfer contact 67*t* of the relay 67 is connected to the connection point of the relay 69 and the make contact 69*s* thereof, and the connection point of the transfer contact 67*t* of the relay 67 and the break contact 68*s'* of the relay 68 is connected to the connection point of the make contact 71*s* of the relay 71 and the timer 70.

Another relay 73 for memorizing the commencement of shifting movement of the shiftable stack units 11, 12 and 13 is connected between the conductors 62 and 64 through another make contact 71*s* of the relay 71 and a make contact 73*s* of the relay 73. Another relay 74 for memorizing the completion of shifting movement of the shiftable stack units 11, 12 and 13 is connected between the conductor 64 and the connection point of the make contact 71*s* of the relay 71 and the make contact 73*s* of the relay 73 through a transfer contact 75*t* of a current detecting relay 75 and through a make contact 74*s* of the relay 74 connected in parallel with the transfer contact 75*t*. The movable contact of the transfer contact 75*t* is connected to the connection point of the relay 73 and the make contact 73*s* thereof. Another timer 76 for previously setting the actuatable period of time of the lever switches 19, 20 and 21 is connected between the conductor 64 and the connection point of the make contact 71*s* of the relay 71 and the make contact 73*s* of the relay through a break contact 73*s* of the relay 73. An auxiliary relay 77 for the locking relay 68 is also connected between the conductor 64 and the connection point of the make contacts 71*s* and 73*s* through a make contact 77*s* of the relay 77. The locking relay 68 is also connected between the conductor 64 and the connection point of the make contacts 71*s* and 73 through another transfer contact 67*t* of the relay 67. The movable contact of this transfer contact 67*t* is connected to the connection point of the relay 77 and the make contact 77*s* thereof. A make contact 68*s* of the relay 68, another make contact 74*s* of the relay 74, the make contact 70*c* of the timer 70, a series connection of a break contact 72*c'* of the timer 72 and a make contact 75*s* of the relay 75, and a make contact 76*c* of the timer 76, are connected in parallel with the transfer contact 67*t* of the relay 67.

The timer 76 acts to close its make contact 76*c* when the lever switches 19, 20 and 21 are not actuated within the predetermined period of time, that is, when the predetermined period of time set by the timer 76 has elapsed. This timer 76 is provided to lock the whole system when anyone of the lever switches 19, 20 and 21 is not actuated after the actuation of anyone of the pull switches 25, 26, 27 and 28. An auxiliary relay 78 for the resetting relay 66 is also connected between the conductors 62 and 64 through another make contact 68*s* of the relay 68 and a make contact 78*s* of the relay 78, and the resetting relay 66 is connected between the conductor 64 and the connection point of the make contact 68*s* of the relay 68 and the make contact 78*s* of the relay 78 through another transfer contact 67*t* of the relay 67. The movable contact of this transfer contact 67*t* is connected to the connection point of the relay 78 and the make contact 78*s* thereof. The switch on-off detecting relay 67 is connected between the conductor 64 and the terminal 36. The terminal 35 is connected to the conductor 62, and the terminal 59 is connected to the conductor 64 through another make contact 68*s* of the locking relay 68.

The current detecting relay 75 detects whether or not current is supplied to the drive motors 31, 32 and 33, that is, whether or not these motors are rotating. This current detecting relay 75 is energized in response to the induction of a voltage in a current transformer which consists of a core 79 and a coil 80 wound around the core 79. This core 79 is disposed between the terminal 39 and a make contact 65*c* of the electromagnetic switch 65 in the conductor 62 which is connected to the terminals 61 and 39 through the make contact 65*c* above described. This current detecting relay 75 is connected between the conductors 62 and 64 connected to the power supply terminals 61 and 63. Another make contact 65*c* of the electromagnetic switch 65 is connected between the terminal 41 and the conductor 64.

The operation of the first embodiment of the present invention will be described with reference to the case in which the shiftable stack unit 12 is moved from the position shown in FIG. 1 toward the shiftable stack unit 13 to form a new aisle between the shiftable stack units 11 and 12. In FIG. 1, an aisle is shown already formed between the shiftable stack units 12 and 13. An article handler enters this existing aisle and pulls the cord 24 of the pull switch 27. In response to the turn-on of the pull switch 27, the switch on-off detecting relay 67 is energized in FIG. 4 and the transfer contact 67*t* thereof are changed over to the other position from the illustrated position. As a result, the auxiliary relay 69 for the electromagnetic switch 65 is energized by the current supplied through the break contact 66*s*'of the relay 66 and the transfer contact 67*t* of the relay 67, and the relay 69 holds itself over the make contact 69*s* thereof which is now closed. The relay 67 is deenergized when the article handler releases his hand from the pull switch 27. The transfer contacts 67*t* of the relay 67 are restored to the illustrated position to energize the electromagnetic switch 65, timers 70, 72 and motor supply memory relay 71, and the relay 71 holds itself over the make contact 71*s* thereof which is now closed. The make contacts 65*c* of the electromagnetic switch 65 are closed as a result of the energization of the electromagnetic switch 65, and power is supplied to the terminals 39 and 41 across which the drive motors 31, 32 and 33 are connected.

Then, when the lever of the lever switch 20 provided on the shiftable stack unit 12 is swung to the right in FIG. 1, power is supplied from the terminal 39 to the common terminal of the drive motor 32 through the conductor 40 in FIG. 3 and also from the terminal 41 to the normal rotation terminal of the drive motor 32 through the conductor 42, limit switch 49 and stationary contact 20*b* of lever switch 20 in FIG. 3. The drive motor 32 is rotated in the normal direction to cause shifting movement of the shiftable stack unit 12 toward the right in FIG. 1. Flow of current through the motor 32 results in induction of a voltage in the current transformer associated with the current detecting relay 75, which is therefore energized. In response to the energization of this relay 75, the memory relay 73 memorizing the commencement of shifting movement of the shiftable stack units is energized by the current supplied through the transfer contact 75*t* of the relay 75, and the relay 73 holds itself over the make contact 73*s* thereof which is now closed.

The shiftable stack unit 12 is moved rightward in FIG. 1 until finally the limit swtich 49 is pressed against the lug 45 provided on the shiftable stack unit 13. The limit switch 49 is turned off to cease rotation of the motor 32. No voltage is now induced in the current transformer associated with the current detecting relay 75 and this relay 75 is deenergized. Consequently, the memory relay 74 memorizing the completion of shifting movement of the shiftable stack units is energized by the current supplied through the make contact 71*s* of relay 71, make contact 73*s* of relay 73 and transfer contact 75*t* of relay 75. Thus, the relay 74 holds itself over the make contact 74*s* thereof which is now closed. Due to the closing of the make contact 74*s* of the relay 74, the locking relay 68 for the electromagnetic switch 65 is energized and holds itself over the make contact 68*s* thereof which is now closed. The energization of this relay 68 results in deenergization of the electromagnetic switch 65, and the motor circut is disconnected from the power source. The make contact 68*s* of the relay 68 is closed due to the energization of the relay 68. Thus, power is supplied from the terminal 59 to the lighting circuit via the limit switch 52 to energize the illumination lamp 30*b*.

Thus, an automatic cut-off circuit is formed, in part, by the timer 76, relays 68, 77 and associated contacts in order to automatically disconnect the motor circuit formed, inter alia, by the electromagntic switch 65 and relay contacts 66*s*', 67*t*, 68*s*' from the conductors 62, 64 of the power supply. The timer circuit which is responsive to actuation of a selected confirmation switch means 25, 26 27 to energize the automatic cut-off circuit is formed, in part, by the timer 70, memory relay 71 and associated contacts.

Upon completion of handling of articles in the article handling aisle formed between the shiftable stack units 11 and 12, the article handler pulls the cord 24 of the pull witch 26 in the aisle. In response to the actuation of the pull switch 26, the relay 67 is energized again and the transfer contacts 67*t* thereof are changed over to the other position from the position illustrated in FIG. 4. The auxiliary relay 78 for the resetting relay 66 is energized and holds itself over the make contact 78*s* thereof which is now closed. When the article handler releases his hand from the cord 24 of the pull switch 26, the transfer contacts 67*t* of the relay 67 are restored to the illustrated position, and the resetting relay 66 is energized. In response to the energization of the relay 66, the relay 69, timers 70, 72 and relay 71 are deenergized. The deenergization of the relay 71 results in deenergization of the relays 68, 73, 74 and 77. The relays 66 and 78 are also deenergized in response to the deenergization of the relay 68, and the whole system is restored to the original state.

The above description has referred to the case in which only one of the shiftable stack units is moved in one direction. When it is desired to form a new aisle between the stationary stack unit 14 and the shiftable stack until 11 from the state shown in FIG. 1, such aisle can be formed by merely pulling the cord 24 of the pull switch 27, swinging the lever of the lever switch 20 provided on the shiftable stack unit 12 to the right, and then swinging the lever of the lever switch 19 provided on the shiftable stack until 11 to the right in FIG. 1. The shiftable stack unit 12 is initially moved toward the right, and the limit switch 48 provided on the shiftable stack unit 11 is turned on due to the above movement of the shiftable stack unit 12 so that the shiftable stack unit 11 is also moved toward the right. The current detecting relay 75 is energized and remains in the energized state so long as the shiftable stack unit 11 continues to move toward the shiftable stack unit 12 which may be stopped at such time. Thus, the drive motor 31 driving the shiftable stack unit 11 is not disconnected from the power source.

The current supplied to the motor circuit would not be interrupted if the limit switches 47 to 50 might fail to operate for some reasons. The timer 70 is provided for reliably disconnecting the motor circuit from the power source even in the event of such trouble. This timer 70 is set to operate for the longest period of time required for the shifting movement of the shiftable stack units as described previously. Thus, when the above time setting is reached, the make contact 70*c* of the timer 70 is closed to energize the locking relay 68, and the electromagnetic switch 65 is deenergized to disconnect the motor circuit from the power source.

It may be desired to energize only one of the illumination lamps 30*a* to 30*d* in an aisle formed already, for example, the lamp 30*c* in the aisle formed between the shiftable stack units 12 and 13 as shown in FIG. 1. This can be attained by merely pulling the cord 24 of the pull switch 27 to establish the state ready for supplying power to the power supply terminals 39 and 41 for the motor circuit and then pulling the cord 24 of the pull switch 27 again. The relay 67 is energized in response to the second pull of the cord 24 of the pull switch 27, and the transfer contacts 67*t* thereof are changed over to the other position from the position illustrated in FIG. 4. The relay 77 is energized and holds itself over the make contact 77*c* thereof which is now closed. When the article handler releases his hand from the cord 24 of the pull switch 27, the transfer contacts 67*t* of the relay 67 are restored to the illustrated position again, and the locking relay 68 is energized and holds itself over the make contact 68*s* thereof which is now closed. Therefore, power is supplied to the terminal 59 to energize the illumination lamp 30*c*.

The electromagnetic switch 65 can be deenergized to disconnect the motor circuit from the power source when anyone of the pull switches 25 to 28 is actuated during the shifting movement of anyone of the shiftable stack units 11 to 13. Therefore, the shifting movement of one or more of the shiftable stack units 11 to 13 can be immediately ceased by actuating the pull switch accessible to the article handler when a situation occurs in which the shifting movement of the shiftable stack units must be ceased. It will thus be seen that the pull switches 25 to 28 act also as an emergency stop means for stopping the shifting movement of the shiftable stack units 11 to 13 as soon as emergency stop is required.

Actuation of the pull switch 27 would not cause shifting movement of the shiftable stack units 12 and 13 when the levers of the lever switches 20 and 21 are locked in such a position that they are not turned toward the aisle formed between these stacks units as shown in FIGS. 1 and 3 or when the levers of the lever switches 20 and 21 are locked in the neutral position. However, when the lever of the lever switch 20 is locked in the rightmost position and/or the lever of the lever switch 21 is locked in the leftmost position in FIG. 1, actuation of the pull switch 27 would immediately cause the shifting movement of the shiftable stack unit 12 and/or the shiftable stack unit 13. This is dangerous for persons who may be present in the aisle. The timer 72 is provided for avoiding such a danger. In FIG. 4, the make contact 75*s* of the current detecting relay 75 and the break contact 72*c*′ of the timer 72 which operates for a predetermined limited period of time are connected in series to energize the locking relay 68 for the electromagnetic switch 65 upon lapse of such limited period of time. Therefore, the shiftable stack units 12 and 13 can be locked against shifting movement in such a case.

The pull switches 25 to 28 may be actuated twice in a manner as described above so as to cease the shifting movement of the shiftable stack units 11 to 13. However, when the article handler fails to make the second actuation of the pull switches, the motor circuit remains connected to the power source and the shiftable stack units are ready to move in either direction. This is dangerous for the article handler present in the aisle formed between the stack units. The timer 76 is provided to obviate such a danger. Upon lapse of a predetermined time setting, the make contact 76*c* of the timer 76 is closed to energize the locking relay 68 which acts to disconnect the motor circuit from the power source. Therefore, even if the article handler fails to make the second actuation of the pull switches, handling of articles in the aisle can be safely carried out after the predetermined period of time for which the timer 76 is set to operate. For example, the timer 76 is set to operate for a period of time which includes the length of time required for actuation of the pull switches and subsequent actuation of the lever switches plus a slight time margin.

It will be understood from the foregoing description of the first embodiment of the present invention that a desired aisle can be simply formed by actuating the pull switch in the already existing aisle to connect the motor circuit to the power source and then actuating the lever switch or switches provided on the shiftable stack units which must be moved to form the desired aisle. It is unnecessary to provide the motion-limiting limit switches at the opposite sides of the respective shiftable stack units and it is only necessary to provide one limit switch at one side of each of the shiftable stack units, due to the fact that the limit switch on one shiftable stock unit acts to regulate the shifting movement of the stack unit itself in one direction and also to regulate the shifting movement of the adjacent shiftable stack units in the other direction. Thus, the control circuit is very simple circuitry and inexpensive and yet the desired safety can be fully ensured.

In the first embodiment of the present invention, the motor circuit is disconnected from the power source when the pull switch in the existing aisle is actuated twice. Therefore, the motor circuit can be reliably disconnect from the power source by merely repeatedly actuating one of the pull switches after the formation of the desired aisle. In such a case, the timer 70, shift commencement memory relay 73, shift completion memory relay 74 and current detecting relay 75 are unnecessary. Further, although the timer 70 is employed in addition to the current detecting relay 75 to disconnect the motor circuit from the power source in the first embodiment of the present invention, the current detecting relay 75 may be eliminated and this timer 70 may solely be used to disconnect the motor circuit from the power source, due to the fact that the timer 70 is set to operate for the maximum length of time required for the shifting movement of the shiftable stack units. In such a case, the relays 73, 74, 75 and 77 are unnecessary, the pull switches need not be actuated twice, and yet the motor circuit can be automatically disconnected from the power source when the time setting for the timer 70 is reached. In the first embodiment of the present invention, the current detecting relay 75 is employed to detect whether or not the motors are rotating, that is, whether or not current is supplied to the motors. Thus, this relay 75 may be utilized to disconnect the motor circuit from the power source. In other words, the motor circuit can be disconnected by the action of the current detecting relay 75 alone, and the timer 70 and relay 77 may be eliminated. Of course, in the arrangement of the first embodiment of the present invention, the pull switches 25 to 28, the timer 70 and the current detecting relay 75 contribute individually to the improved safety.

In the first embodiment of the present invention, the illumination lamp in the aisle formed by the shifting movement of the shiftable stack unit or units is automatically lit by actuating the pull switch in the aisle for connecting the system to the power source and then actuating this pull switch again or actuating the lever switch or switches. However, when the illumination is unnecessary, the resetting relay 66 and the auxiliary relay 78 therefor in the control circuit in FIG. 4 are unnecessary. In such a case, the relay contacts of these relays ae eliminated in FIG. 4, and another break contact 68*s'* of the locking relay 68 may be disposed in place of the break contact 66*s'* of the resetting relay 66 connected to the conductor 62.

Figure 5:
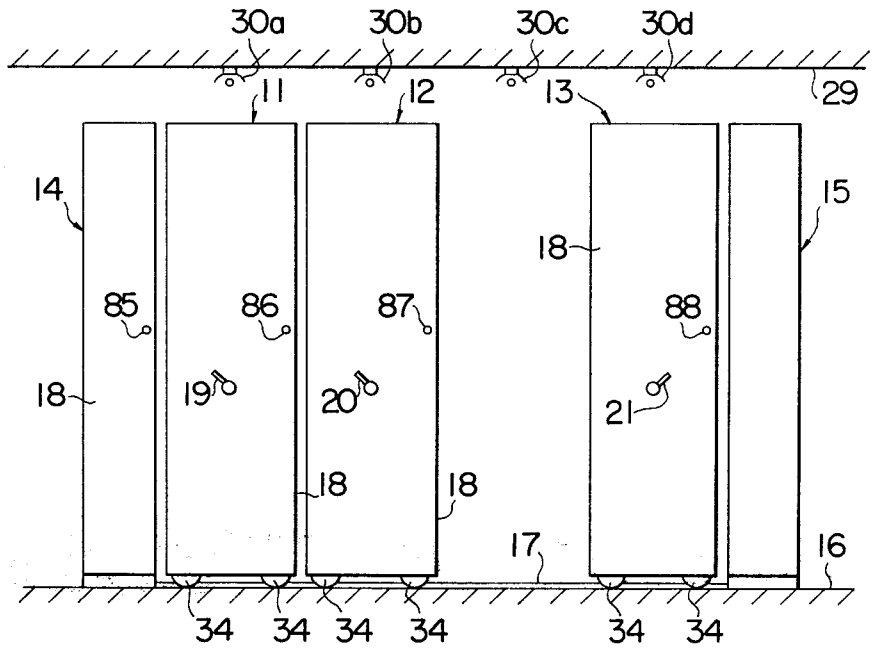
FIG. 5 is a front elevational view of a second embodiment of the present invention.
Figure 6:
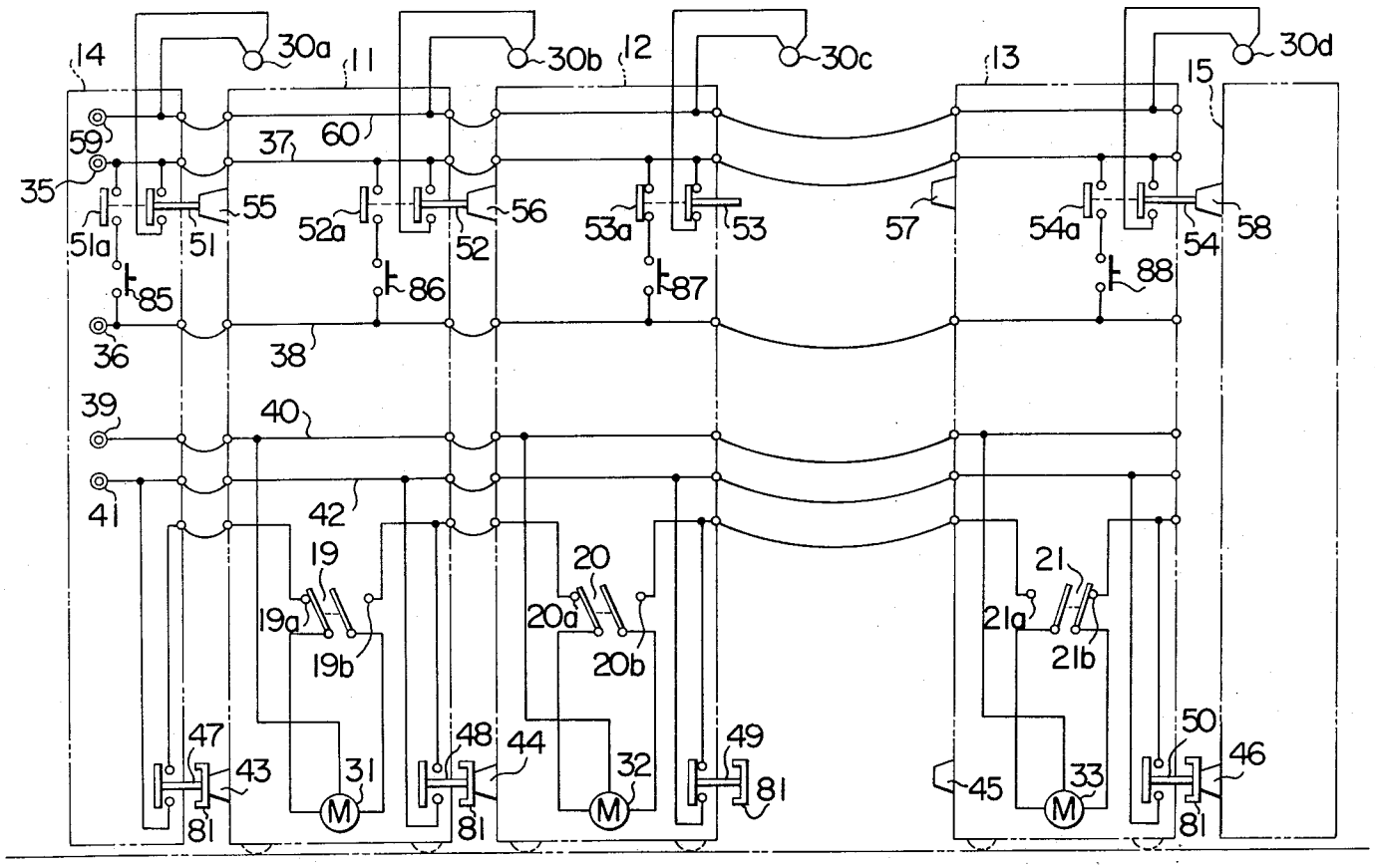
FIG. 6 shows a control mechanism for the second embodiment of the present invention.

FIGS. 5 and 6 show a second embodiment of the present invention which is a modification of the first embodiment described with reference to FIGS. 1 to 4. In the first embodiment of the present invention, the motor circuit is connected to the power source in response to the actuation of the pull switches provided in the individual aisles, but in the second embodiment or modification shown in FIGS. 5 and 6, the motor circuit is connected to the power source in response to the actuation of push button switches provided on the side wall of the stack units adjacent to the entrance of the individual aisles.

Referring to FIG. 5, push button switches 85, 86, 87 and 88 are mounted on the side wall 18 of the stationary stack unit 14 and shiftable stack units 11, 12 and 13 respectively. These push button switches 85 to 88 are turned on and off respectively when they are depressed and the depressing force is released. As shown in FIG. 5, the push button switch 85 is mounted on the side wall 18 of the stationary stack unit 14 at a position adjacent to the shiftable stack unit 11, the push button switch 86 is mounted on the side wall of the shiftable stack unit 11 at a position adjacent to the shiftable stack unit 12, and so on. In other words, these push button switches 85 to 88 are disposed at such a position which is convenient for confirming the state of the aisle formed between the adjacent stack units.

FIG. 6 shows a control mechanism for the second embodiment of the present invention. This control mechanism is generally similar to that shown in FIG. 3 except that the limit switches 51 to 54 are of the double-pole type and that series connections of the interlocking contact 51*a* of the limit switch 51 and the push button switch 85, the interlocking contact 52*a* of the limit switch 52 and the push button switch 86, the interlocking contact 53*a* of the limit switch 53 and the push button switch 87, and the interlocking contact 54*a* of the limit switch 54 and the push button switch 88, are connected in parallel between the conductors 37 and 38. This second embodiment has a control circuit which is the same as that shown in FIG. 4.

When it is desired to form a new aisle in the state shown in FIG. 5 in which an aisle is present already between the shiftable stack units 12 and 13, the push button switch 87 provided at the entrance of the already existing aisle is depressed. In response to the turn-on of the push button switch 87, the relay 67 (FIG. 4) is energized by the current supplied via the interlocking contact 53*a* of the limit switch 53 to connect the motor circuit to the power source. The shiftable stack unit 12 or 13 is then moved in either direction to form a new aisle. The aisle previously existed in now closed and the limit switch 52 or 54 associated with the newly formed aisle is turned on to energize the illumination lamp 30*b* or 30*d*. Subsequently, the motor circuit is disconnected from the power source and the whole system is locked as described in the first embodiment of the present invention.

In the first embodiment described with reference to FIGS. 1 to 4, the pull switch in the already existing aisle can only be actuated to connect the motor circuit to the power source. In the second embodiment, anyone of the push button switches can be actuated for the purpose of connecting the motor circuit to the power source. However, due to the fact that the motor circuit is not connected to the power source unless the specific push button switch associated with the already existing aisle is actuated, the state of the existing aisle can necessarily be confirmed before the shiftable stack unit or units are moved to form a new aisle. Even when the push button switch associated with one of the closed aisles may be depressed, the associated limit switch is in the off position and the motor circuit cannot be connected to the power source.

Figure 7:
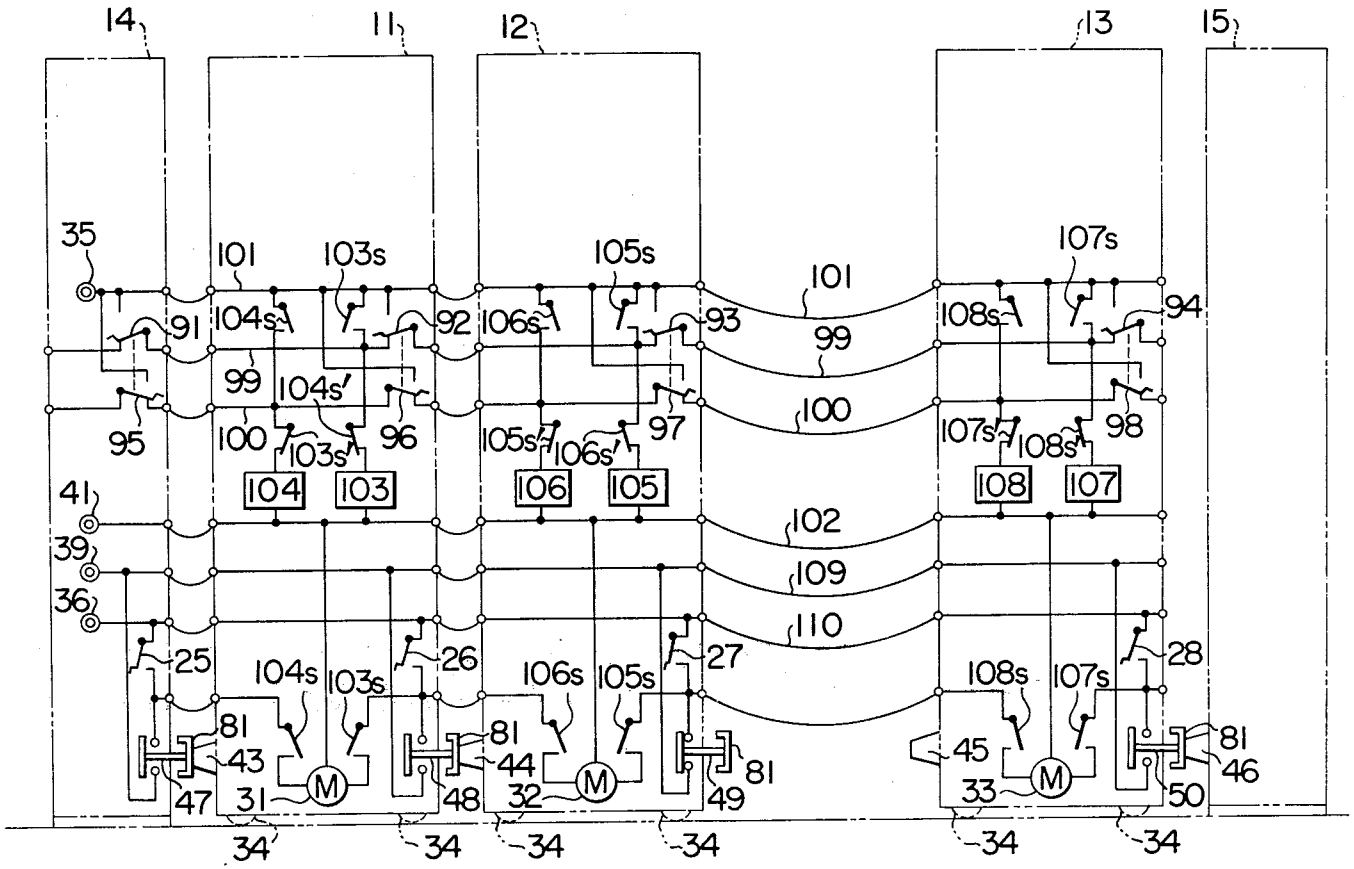
FIG. 7 shows a control mechanism for a third embodiment of the present invention.

FIG. 7 shows a control mechanism for a third embodiment of the present invention. In this third embodiment, the lever switches in the first and second embodiments are replaced by aisle switches, and one of the aisle switches associated with an aisle to be newly formed is merely turned on to form the desired aisle.

Referring to FIG. 7, an aisle switch 91 is provided on a side wall of a stationary stack unit 14 at a position adjacent to a shiftable stack unit 11 to instruct formation of an aisle between the stationary stack unit 14 and the shiftable stack unit 11. Another aisle switch 92 is provided on a side wall of the shiftable stack unit 11 at a position adjacent to another shiftable stack unit 12 to instruct formation of an aisle between the shiftable stack units 11 and 12. Another aisle switch 93 is provided on a side wall of the shiftable stack unit 12 at a position adjacent to another shiftable stack unit 13 to instruct formation of an aisle between the shiftable stack units 12 and 13. Similarly, another aisle switch 94 is provided on a side wall of the shiftable stack unit 13 at a position adjacent to another stationary stack unit 15 to instruct formation of an aisle between the shiftable and stationary stack units 13 and 15. These aisle switches 91 to 94 are combined with interlocking switches 95 to 98 which are arranged for interlocking operation with the respective aisle switches and have their movable contact connected in a direction opposite to the connecting direction of the movable contact of the respective aisle switches. The aisle switches 91 to 94 and the interlocking switches 95 to 98 are connected in series with respective conductors 99 and 100. These switches 91 to 98 are connected at the stationary contact thereof to another conductor 101 connected to a terminal 35. Another conductor 102 is connected to another terminal 41.

In the shiftable stack unit 11, a normal rotation instruction relay 103 instructing the normal rotation of a reversible drive motor 31 is connected between the conductors 99 and 102 through a break contact 104*s'* of a reverse rotation instruction relay 104 which instructs the reverse rotation of the drive motor 31. This reverse rotation instruction relay 104 is connected between the conductors 100 and 102 through a break contact 103*s'* of the normal rotation instruction relay 103. A make contact 103*s'* of the relay 103 is connected between the conductors 101 and 99, and a make contact 104*s* of the relay 104 is connected between the conductors 101 and 100. In the shiftable stack units 12 and 13 too, normal rotation instruction relays 105, 107 and reverse rotation instruction relays 106, 108 are connected between the conductors 99 and 102 and between the conductors 100 and 102 respectively as in the shiftable stack unit 11.

A limit switch 48 is mounted on the shiftable stack unit 11 and is connected at one terminal thereof to another conductor 109 connected to another terminal 39. The other terminal of the limit switch 48 is connected through a power on-off switch 26 to another conductor 110 connected to another terminal 36. Limit switches 49, 50 and 47 are mounted on the shiftable stack units 12, 13 and stationary stack unit 14 respectively and are similarly connected between the conductors 109 and 110. Similar power on-off switches 25, 27 and 28 are provided on the respective stack units 14, 12 and 13 to be similarly connected between the conductors 109 and 110.

The common terminal of the drive motor 31 driving the shiftable stack unit 11 is connected directly to the conductor 102. The normal rotation terminal of the drive motor 31 is connected through another make contact 103*s* of the relay 103 to the connection point of the switch 26 and the limit switch 48, while the reverse rotation terminal of the drive motor 31 is connected through another make contact 104*s* of the relay 104 to the connection point of the limit switch 47 and the switch 25 provided on the stationary stack unit 14. Another reversible drive motor 32 driving the shiftable stack unit 12 is also connected at the common terminal thereof to the conductor 102 directly. The normal rotation terminal of the motor 32 is connected through a make contact 105*s* of the relay 105 to the connection point of the limit switch 49 and the switch 27, while the reverse rotation terminal of the drive motor 32 is connected through a make contact 106*s* of the relay 106 to the connection point of the limit switch 48 and the switch 26 provided on the shiftable stack unit 11. Similarly, another reversible drive motor 33 driving the shiftable stack unit 13 is connected at the common terminal thereof to the conductor 102 directly. The normal rotation terminal of the drive motor 33 is connected through a make contact 107*s* of the relay 107 to the connection point of the limit switch 50 and the switch 28, while the reverse rotation terminal of the drive motor 33 is connected through a make contact 108*s* of the relay 108 to the connection point of the limit switch 49 and the switch 27 provided on the shiftable stack unit 12.

This third embodiment has a control circuit which is generally similar to that of the first embodiment shown in FIG. 4 except that the conductor 62 is directly connected to the terminal 39 without passing through the make contact 65*c* of the electromagnetic switch 65 and that the timer 72 is eliminated.

The operation of the third embodiment of the present invention will be described with reference to the case in which the shiftable stack units 12 and 11, for example, are moved from the position shown in FIG. 7 to form a new aisle between the stationary stack unit 14 and the shiftable stack unit 11. The operation of the control means in the control circuit will not be especially described herein since this control circuit is substantially similar to that shown in FIG. 4.

In operation, absence of any obstacles in the aisle formed already between the shiftable stack units 12 and 13 is initially confirmed, and then the switch 27 is turned on to supply power from the power source to the terminals 35, 36, 39 and 41 via the control circuit. Subsequently, the aisle switch 91 is actuated to change over the movable contact thereof from the illustrated position to the other position thereby connecting the conductor 99 to the terminal 35. The power supply voltage is applied to the conductor 99 from the terminal 35 via the aisle switch 91 to energize the normal rotation instruction relays 103, 105 and 107 associated with the respective shiftable stack units 11, 12 and 13. However, due to the fact that the limit switches 48 and 50 mounted on the respective shiftable stack units 11 and 13 remain in the off position and the limit switch 49 mounted on the shiftable stack unit 12 is solely in the on position, the drive motors 31 and 33 do not make rotation, and the drive motor 32 in the shiftable stack unit 12 is solely rotated in the normal direction to cause shifting movement of the shiftable stack unit 12 toward the right in FIG. 7. Due to the rightward shifting movement of the shiftable stack unit 12, the limit switch 48 mounted on the shiftable stack unit 11 is turned on, and the motor 31 is also rotated in the normal direction to cause shifting movement of the shiftable stack unit 11 toward the right in FIG. 7.

At the extremity of the rightward shifting movement of the shiftable stack unit 12, the limit switch 49 is engaged by a lug 45 provided on the shiftable stack unit 13 and is urged to the off position, and the drive motor 32 in the shiftable stack unit 12 ceases to rotate. The drive motor 31 in the shiftable stack unit 11 ceases also to rotate when the limit switch 48 mounted on the shiftable stack unit 11 is engaged by a lug 44 provided on the shiftable stack unit 12. Therefore, an aisle is formed between the stationary stack unit 14 and the shiftable stack unit 11. The motor circuit is disconnected from the power source and the whole system is locked as in the first embodiment of the present invention.

The aisle switches 91 to 94 are of the type in which the movable contact thereof is changed over to the other position from the original position in response to depression and is restored to the original position in response to release of the depressing pressure. These aisle switches are employed in combination with the normal and reverse rotation instruction relays which are adapted for holding themselves. Thus, it is merely necessary to depress these aisle switches only once to cause shifting movement of the shiftable stack units.

Illumination means in this third embodiment are not especially shown in FIG. 7 since such means are entirely the same as those employed in the first and second embodiments.

The third embodiment of the present invention is advantageous over the first and second embodiments in that any desired aisle can be very simply formed by merely actuating the aisle switch associated with the desired aisle to be formed. Further, actuation of the power on-off switches corresponding to closed aisles does not connect the motor circuit to the power source due to the fact that the associated limit switches remain in the off position. Thus, the power on-off switch corresponding to an already existing aisle must necessarily be actuated in order to connect the motor circuit to the power source. These switches may be similar to those employed in the first embodiment or may be disposed adjacent to the entrance of the individual aisles in a manner similar to the switch arrangement employed in the second embodiment.

In the first, second and third embodiments of the present invention, the limit switches operative to stop the rotation of the motors, hence the shifting movement of the shiftable stack units are each disposed at only one side of the adjacent stack units forming an aisle therebetween. In a fourth embodiment of the present invention shown in FIG. 8, shiftable stack units disposed between a pair of stationary stack units are each provided with a pair of such limit switches at opposite sides thereof respectively.

Figure 8:
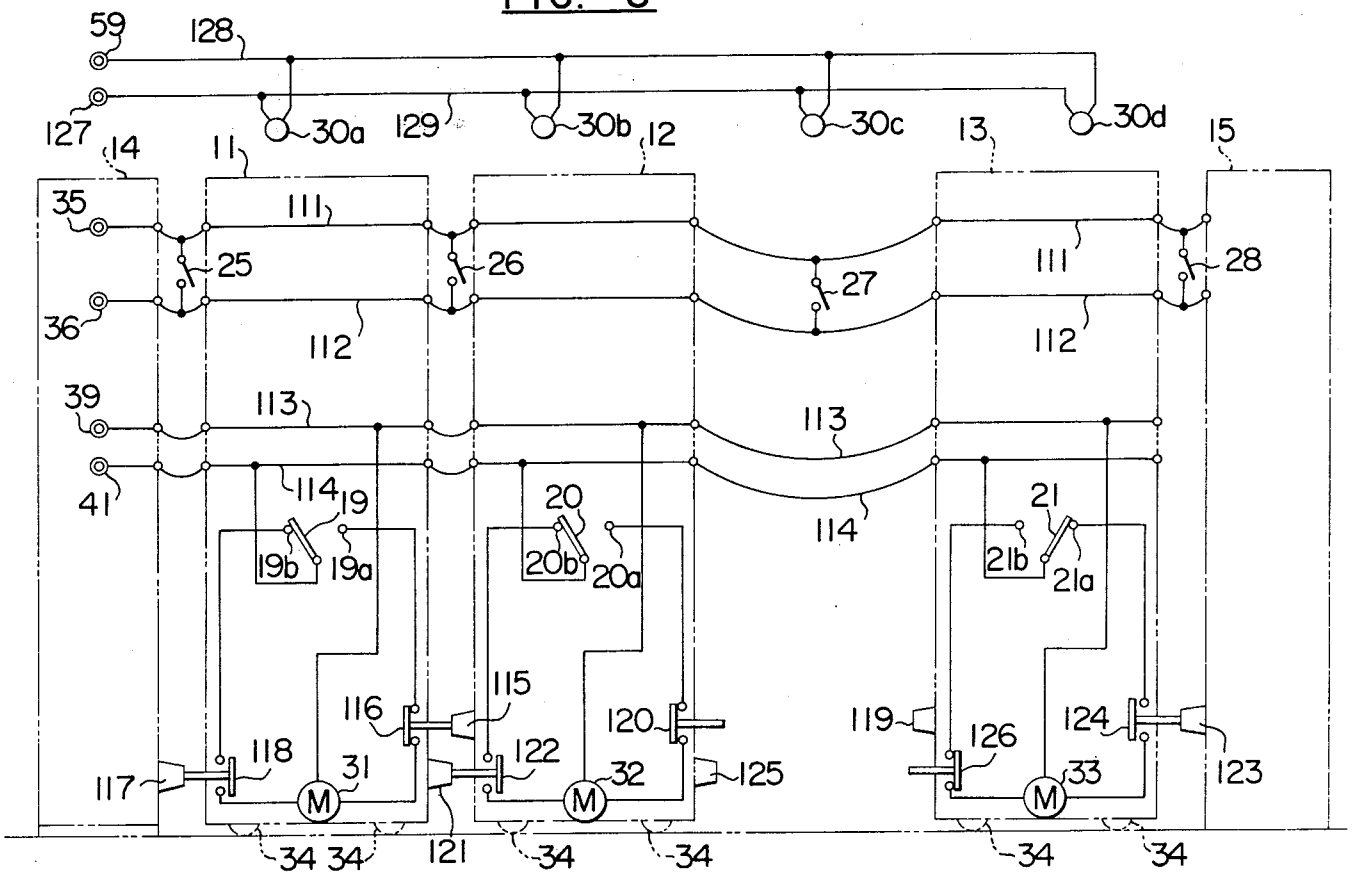
FIG. 8 shows a control mechanism for a fourth embodiment of the present invention.

Referring to FIG. 8 showing a control mechanism for shiftable stack units 11 to 13 disposed between a pair of stationary stack units 14 and 15 and also showing a lighting circuit in the fourth embodiment of the present invention, power on-off switches or pull switches 25, 26, 27 and 28 similar to those shown in FIG. 2 are connected in parallel between a pair of conductors 111 and 112 connected to respective terminals 35 and 36. Reversible drive motors 31, 32 and 33 mounted in the respective shiftable stack units 11, 12 and 13 are connected at the common terminal thereof to another conductor 113 connected to another terminal 39. Lever switches 19, 20 and 21 each having a movable contact and a pair of stationary contacts are mounted on the respective shiftable stack units 11, 12 and 13 and are connected at the movable contact thereof to another conductor 114 connected to another terminal 41. The lever switch 19 for causing shifting movement of the shiftable stack unit 11 is connected at the stationary contact 19*a* thereof to the normal rotation terminal of the drive motor 31 through a limit switch 116. This limit switch 116 is disposed at a position engageable with a lug 115 provided at a lower part of the shiftable stack unit 12 so that it can be turned off when engaged by the lug 115 and turned on when disengaged from the lug 115. The lever switch 19 is connected at the stationary contact 19*b* thereof to the reverse rotation terminal of the drive motor 31 through another limit switch 118. This limit switch 118 is disposed at a position engageable with lug 117 provided at a lower part of the stationary stack unit 14 so that it can be turned off when engaged by the lug 117 and turned on when disengaged from the lug 117. The lever switch 20 for causing shifting movement of the shiftable stack unit 12 is connected at the stationary contact 20*a* thereof to the normal rotation terminal of the drive motor 32 through another limit switch 120 of the kind above described which is disposed at a position engageable with a lug 119 provided at a lower part of the shiftable stack unit 13. The lever switch 20 is connected at the stationary contact 20*b* thereof to the reverse rotation terminal of the drive motor 32 through another limit switch 122 of the kind above described which is disposed at a position engageable with a lug 121 provided at a lower part of the shiftable stack unit 11. Similarly, the lever switch 21 for causing shifting movement of the shiftable stack unit 13 is connected at the stationary contact 21*a* thereof to the normal rotation terminal of the drive motor 33 through another limit switch 124 of the kind above described which is disposed at a position engageable with a lug 123 provided at a lower part of the stationary stack unit 15. The lever switch 21 is connected at the stationary contact 21*b* thereof to the reverse rotation terminal of the drive motor 33 through another limit switch 126 of the kind above described which is disposed at a position engageable with a lug 125 provided at a lower part of the shiftable stack unit 12. Illumination lamps 30*a*, 30*b*, 30*c* and 30*d* are connected in parallel between a pair of conductors 128 and 129 connected to respective terminals 59 and 127.

The same control circuit as that shown in FIG. 4 can be used for controlling the article storage device embodying the fourth form of the present invention. Therefore, the individual terminals in FIG. 8 are connected to the terminals denoted by the same reference numerals in FIG. 4. The additional terminal 127 in the fourth embodiment is connected to the terminal 35 in FIG. 4.

In operation, when it is desired to form a new aisle between the shiftable stack unit 11 and the stationary stack unit 14 in the state in which an aisle is formed already between the shiftable stack units 12 and 13 as shown in FIG. 8, such aisle can be easily formed by merely manipulating the pull switch 27 at first, swinging the lever of the lever switch 20 to the rightmost position, and then swinging the lever of the lever switch 19 to the rightmost position. In response to the manipulation of the pull switch 27, power is supplied to the power supply terminals 39 and 41 for the motor circuit as in the first embodiment of the present invention. Therefore, the rightward shifting movement of the shiftable stack unit 12 takes place, and then the rightward shifting movement of the shiftable stack unit 11 takes place due to the fact that the limit switch 116 mounted on the shiftable stack unit 11 is turned on as a result of the above movement of the shiftable stack unit 12. The limit swtich 120 mounted on the shiftable stack unit 12 is turned off when it is engaged by the lug 119 provided on the shiftable stack unit 13. Even when the limit switch 120 is turned off, the motor circuit is not disconnected from the power source and the shiftable stack unit 11 can continue to move toward the right due to the fact that the current detecting relay 75 in FIG. 4 is held in the energized state. In this manner, the rightward shifting movement of the shiftable stack units is regulated by the limit switch provided at the right-hand side of each shiftable stack unit. Similarly, the leftward shifting movement of the shiftable stack units is regulated by the limit switch provided at the left-hand side of each shiftable stack unit. In the fourth embodiment of the present invention, power is supplied to the terminals 59 and 127 in response to the energization of the locking relay 68 in FIG. 4, and all the illumination lamps 30*a* to 30*d* are lit.

Figure 9:
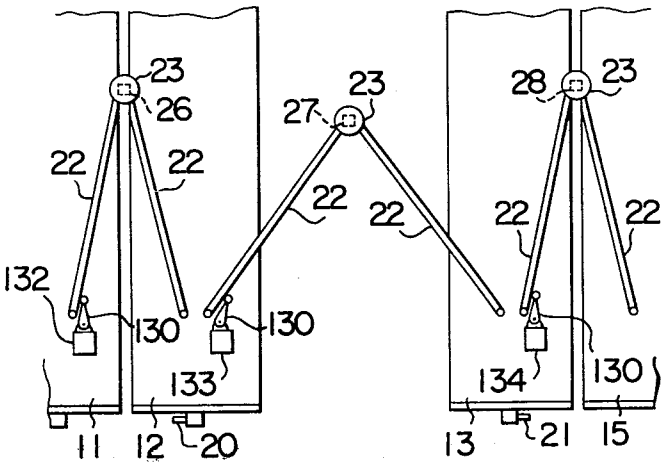
FIG. 9 is a partial plan view of a fifth embodiment of the present invention.
Figure 10:
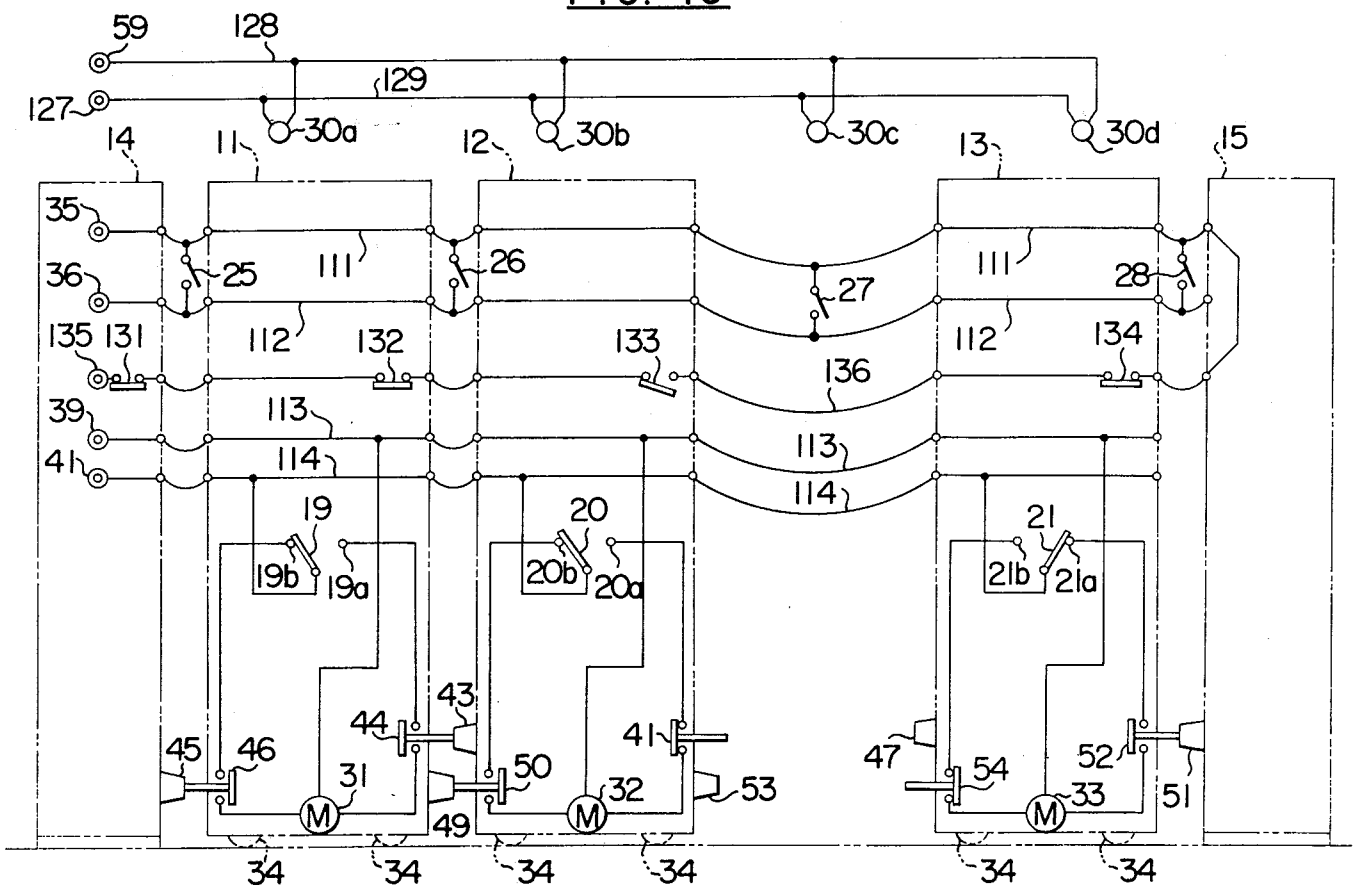
FIG. 10 shows a control mechanism for the fifth embodiment of the present invention.
Figure 11:
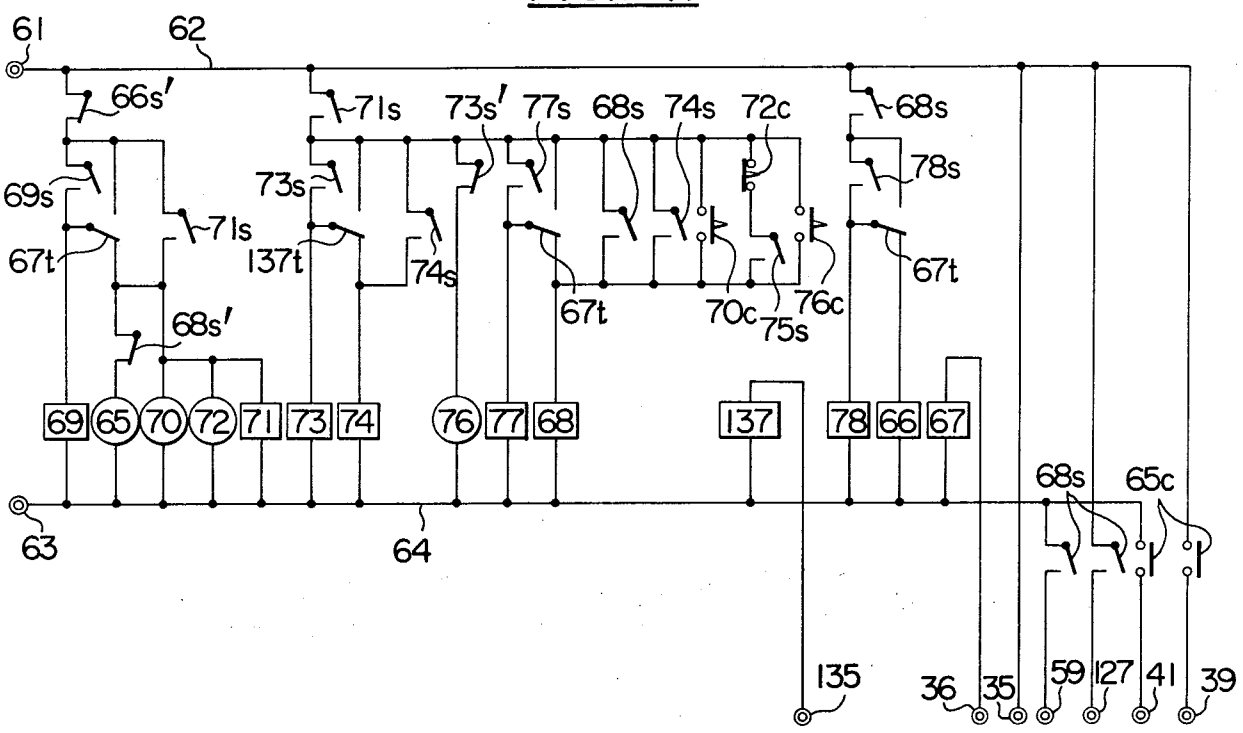
FIG. 11 shows a control circuit for the fifth embodiment of the present invention.

FIGS. 9 to 11 show a fifth embodiment of the present invention. This fifth embodiment utilizes the fact that each pair of swinging arms supporting a pull switch on the free end connection and pivoted at the other end thereof to a stationary and a shiftable stack unit or to two shiftable stack units make swinging movement with the aisle forming or closing movement of the shiftable stack units. An on-off switch cooperating with one of the swinging arms forming each pair is provided adjacent to the pivoted end of the swinging arm to detect the formation of the aisle between the stack units.

The article storage device embodying the fifth form of the present invention will be described in detail with reference to FIG. 9. Referring to FIG. 9, a pair of swinging arms 22 are connected at one or free end thereof by a hinge 23 and are pivoted at the other end thereof to a pair of shiftable stack units 11 and 12 to swingably extend between these stack units 11 and 12. An aisle formation detecting switch 132 having a lever 130 is provided on the shiftable stack unit 11 adjacent to the pivoted end of one of the swinging arms 22 as shown in FIG. 9. This switch 132 is normally in the on position when no aisle is formed between the stack units 11 and 12, but when an aisle is formed between the stack units 11 and 12, the lever 130 is pressed by the swinging arm 22 to turn off the switch 132. Similar pairs of swinging arms 22 extend between the shiftable stack unit 12 and another shiftable stack unit 13, and between the shiftable stack unit 13 and a stationary stack unit 15. Similar aisle formation detecting switches 133 and 134 are shown provided adjacent to the pivoted end of the swinging arms 22 on the respective stack units 12 and 13. Although not shown in FIG. 9, another pair of swinging arms 22 extend between another stationary stack unit 14 and the shiftable stack unit 11, and another aisle formation detecting switch 131 of similar structure is provided adjacent to the pivoted end of the swinging arm 22 on the stationary stack unit 14. Therefore, in a state as shown in FIG. 9, the aisle formation detecting switches 131, 132 and 134 are in the on position and the switch 133 is in the off position.

FIG. 10 shows a control mechanism and a lighting circuit in the fifth embodiment of the present invention. The control mechanism shown in FIG. 10 is entirely the same as that for the fourth embodiment shown in FIG. 8 except that it includes an additional circuit which is connected to the conductor 111 and in which the aisle formation detecting switches 131, 132, 133 and 134 are connected in series by a conductor 136 connected to a terminal 135. Therefore, detailed description of the components of the control mechanism shown in FIG. 10 is unnecessary.

FIG. 11 shows a control circuit in the fifth embodiment of the present invention. The control circuit shown in FIG. 11 is entirely the same as that shown in FIG. 4 except that the current detecting relay 75 and the current transformer are eliminated, and the transfer contact 75*t* of the current detecting relay 75 is replaced by a transfer contact 137*t* of an aisle formation detecting relay 137 described below. Thus, an electromagnetic switch 65, an auxiliary relay 69 therefor, a locking relay 68, a motor supply memory relay 71, a shift commencement memory relay 73, and a shift completion memory relay 74 operate in entirely the same manner as those shown in FIG. 4. The terminal 127 in FIG. 10 is connected to the terminal 35 in FIG. 4 as in the fourth embodiment. The aisle formation detecting relay 137 is energized when all the aisle formation detecting switches 131 to 134 are in the on position, that is, when, for example, the aisle formed already between the shiftable stack units 12 and 13 in FIG. 9 is partly closed due to shifting movement of the shiftable stack unit 12 relative to the shiftable stack unit 13 and the switch 133 is turned on from the off position. The aisle formation detecting relay 137 is kept in the energized state until a new aisle is formed and the aisle formation detecting switch corresponding to the newly formed aisle is turned off. This relay 137 is connected between the terminal 135 and the conductor 64.

In operation, the motor circuit is connected to the power source and a desired aisle is formed by actuating the lever switch or switches in entirely the same manner as that described with reference to the first and fourth embodiments. In the state shown in FIG. 9, the aisle formation detecting switch 133 is solely in the off position and the remaining switches 131, 132 and 134 are in the on position. As a new aisle is formed, the aisle existing already between the shiftable stack units 12 and 13 is gradually closed resulting in turn-on of the aisle formation detecting switch 133. Therefore, the aisle formation detecting relay 137 is energized in FIG. 11, and the transfer contact 137*t* thereof is changed over to the other position from the illustrated position. The shift commencement memory relay 73 is energized by the current supplied via a make contact 71*s* of the motor supply memory relay 71 and via the transfer contact 137*t* of the aisle formation detecting relay 137, and this relay 73 holds itself over a make contact 73*s* thereof which is now closed. In response to the formation of the desired aisle, the corresponding aisle formation detecting switch is turned off to deenergize the aisle formation detecting relay 137, and the transfer contact 137*t* of the relay 137 is restored to the illustrated position. The shift completion memory relay 74 is energized by the current supplied via the make contact 71*s* of the relay 71, the make contact 73*s* of the relay 73 and the transfer contact 137*t* of the relay 137, and this relay 74 holds itself over a make contact 74*s* thereof which is now closed. In response to the energization of this relay 74, the locking relay 68 is energized by the current supplied via another make contact 74*s* of the relay 74 and holds itself over a make contact 68*s* thereof which now closed. A break contact 68*s*' of this relay 68 is opened to deenergize the electromagnetic switch 65, and the motor circuit is disconnected from the power source. All the illumination lamps 30*a* to 30*d* are energized by the current supplied via another make contact 68*s* of the relay 68.

Figure 12:
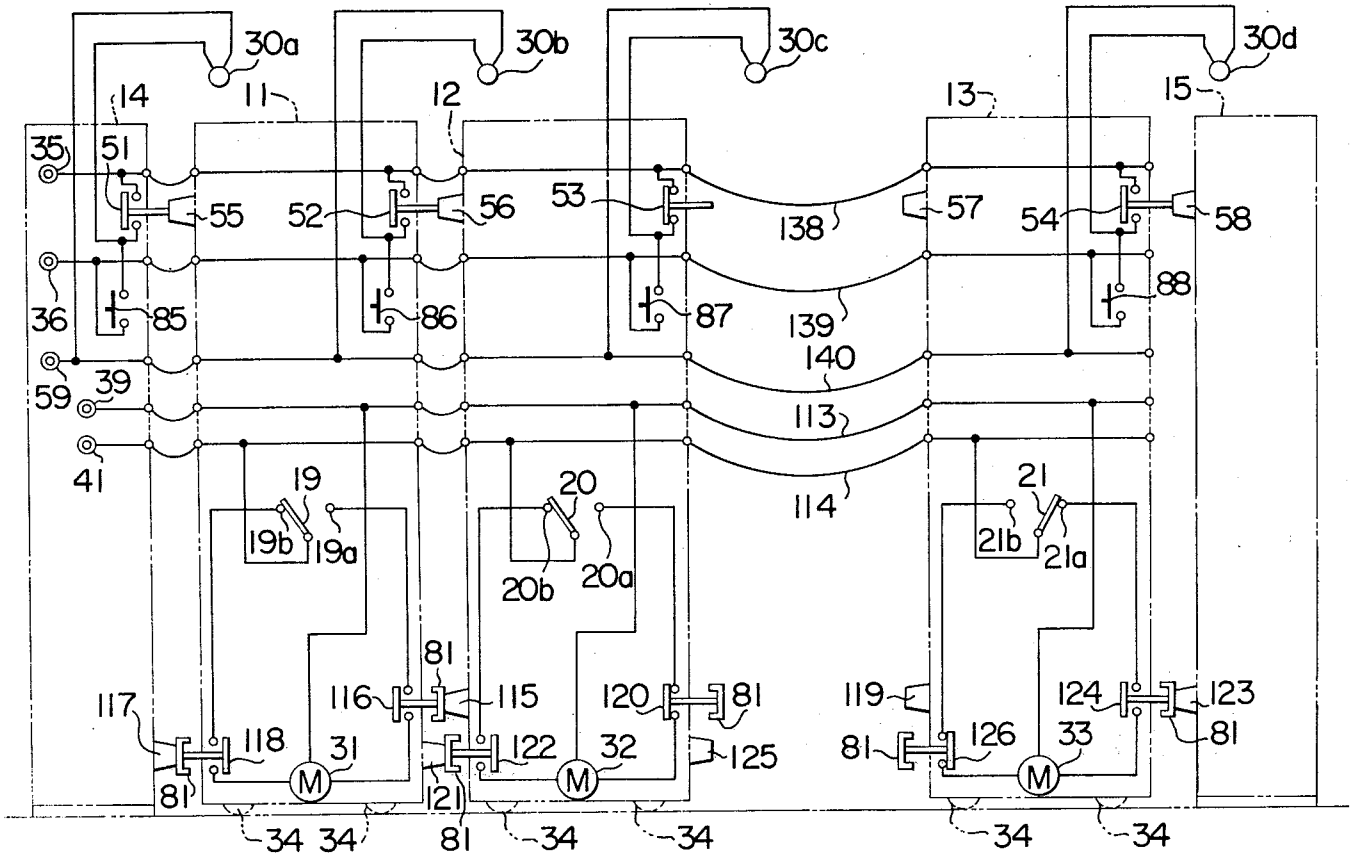
FIG. 12 shos a control mechanism for a sixth embodiment of the present invention.

In a sixth embodiment of the present invention, push button switches acting as power on-off switches are provided adjacent to the entrance of individual aisles to supply power to reversible drive motors as in the second embodiment. FIG. 12 shows a control mechanism and a lighting circuit for the article storage device embodying the sixth form of the present invention.

These push button switches 85, 86, 87 and 88 are mounted on a stationary stack unit 14 and shiftable stack units 11, 12, 13 respectively and are similar to those shown in FIG. 5, and therefore, it is unnecessary to describe as to these push button switches in further detail. In the sixth embodiment, limit switches 51 to 54 similar to those shown in FIG. 3 are employed to detect whether or not the associated aisles are formed. Series connections of the limit switch 51 and push button switch 85, limit switch 52 and push button switch 86, limit switch 53 and push button switch 87, and limit switch 54 and push button switch 88 are connected in parallel between a pair of conductors 138 and 139 connected to respective terminals 35 and 36. In this embodiment, illumination lamps 30*a* to 30*d* are arranged so that the lamp in the desired aisle is solely energized to illuminate such aisle as in the first embodiment. Thus, the illumination lamp 30*a* is connected between a conductor 140 and the connection point of the limit switch 51 and the push button switch 85, the illumination lamp 30*b* is connected between the conductor 140 and the connection point of the limit switch 52 and the push button switch 86, and so on. The sixth embodiment of the present invention comprises a control circuit which is the same as that employed in the first embodiment.

Suppose that an aisle is existing already between the shiftable stack units 12 and 13 as shown in FIG. 5. In response to the depression of the push button switch 87 provided on the side wall 18 of the shiftable stack unit 12, power is supplied to the motor circuit via the limit switch 53 to cause shifting movement of the shiftable stack unit 12 or 13 for forming a new aisle. The existing aisle between the shiftable stack units 12 and 13 is closed, and the limit switch 52 or 54 associated with the newly formed aisle is turned on. At the same time, the illumination lamp 30*b* or 30*d* is energized to illuminate the newly formed aisle. The motor circuit is disconnected from the power source and the whole system is locked as in the first embodiment. In this embodiment too, bars 81 similar to those employed in the first embodiment are provided to detect presence of obstacles in the aisles.

What is claimed is:

1. An electrically-operated article storage device comprising a plurality of shiftable article storage units, each of said units having a face disposed opposite to a face of an adjacent unit and being movable relative to an adjacent unit to form an individual article handling aisle therebetween;

a reversible drive motor mounted on each said article storage unit for moving said respective unit in a direction normal to said face thereof;

a control switch means disposed on each said article storage unit and interconnected to said drive motor on said respective unit for selectively rotating said drive motor in a normal direction and a reverse direction;

a regulating means disposed on each said article storage unit forming an aisle between an article storage face thereof and an article storage face of an adjacent unit facing each other on opposite sides of said aisle, each respective regulating means being operable to detect shifting movement of one of said storage units forming said aisle toward and away from the adjacent unit and being interconnected to a respective drive motor on said one unit to deactivate said drive motor in response to a movement of said one unit proximate the adjacent unit; and confirmation switch means disposed for each said article handling aisle at a position at which the state of said article handling aisle can be readily confirmed, each said confirmation switch means being interconnected with a respective drive motor to permit activation of said motor in response to activation of said confirmation switch means, whereby shifting movement of one or more of said article storage units to form a new article handling aisle is permitted only when said confirmation switch means associated with an already existing article handling aisle is actuated.

2. An electrically-operated article storage device as set forth in claim 1 which further comprises a control power supply; and a control circuit including a motor circuit selectively connecting said drive motors to said control power supply, an automatic cut-off circuit for automatically disconnecting said motor circuit from said control power supply, and a timer circuit responsive to actuation of a selected confirmation switch means for energizing said automatic cut-off circuit to disconnect said motor circuit from said control power supply upon termination of a predetermined time when said control switch means is not actuated or fails to operate within said predetermined time.

3. An electrically-operated article storage device as claimed in claim 2 wherein said control circuit further comprises a current detecting circuit responsive to variations in motor current to energize said automatic cut-off circuit to disconnect said motor circuit from said control power supply.

4. An electrically-operated article storage device as claimed in claim 2 which further comprises extensible connecting means extending between adjacent ones of said article storage units, and aisle formation detecting switch means associated with each said connecting means, said aisle formation detecting switch means being responsive to a predetermined spaced interval between adjacent article storage devices to energize said automatic cut-off circuit for disconnecting said motor circuit from said control power supply.

5. An electrically-operated article storage device as claimed in claim 3 wherein a selected one of said confirmation switch means is disposed in an individual article handling aisle formed between two selected article storage units for actuation therein.

6. An electrically-operated article storage device as claimed in claim 3 wherein said confirmation switch means are disposed on said article storage units at a position adjacent to the entrance of the individual article handling aisles, and said confirmation switch means disposed on one of said article storage units opposite to an already existing aisle is operable to permit shifting movement of said article storage units.

7. An electrically-operated article storage device as claimed in claim 2 wherein said automatic cut-off circuit includes a circuit for detecting a repeated actuation of said confirmation switch means for disconnecting said motor circuit from said control power supply in response thereto.

8. An electrically-operated article storage device as claimed in claim 1 wherein said control switch means are manual switch means for directly instructing the respective directions of shifting movement of said article storage units.

9. An electrically-operated article storage device as claimed in claim 8 which further comprises a control power supply; and a control circuit including a motor circuit selectively connecting said drive motors to said control power supply, an automatic cut-off circuit for automatically disconnecting said motor circuit from said control power supply and a timer circuit responsive to actuation of a selected confirmation switch means for energizing said automatic cut-off circuit to disconnect said motor circuit from said control power supply upon termination of a predetermined time when said contol switch means is not actuated or fails to operate within said predetermined time.

10. An electrically-operated article storage device as claimed in claim 9 wherein said control circuit further comprises a current detecting circuit responsive to variations in motor current to energize said automatic cut-off circuit to disconnect said motor circuit from said control power supply.

11. An electrically-operated article storage device as claimed in claim 8 which further comprises extensible connecting means extending between adjacent ones of said article storage units and aisle formation detecting switch means associated with each said connecting means, said aisle formation detecting switch means being responsive to a predetermined spaced interval between adjacent article storage devices to energize said automatic cut-off circuit for disconnecting said motor circuit from said control power supply.

12. An electrically-operated article storage device as claimed in claim 1 wherein said control switch means include aisle switch means disposed for the individual article handling aisles for permitting actuation of said control switch means so that the direction of shifting movement of said article storage units can be automatically instructed in response to the actuation of said aisle switch means associated with a desired article handling aisle to be formed.

13. An electrically-operated article storage device as claimed in claim 12 which further comprises a control power supply; and a control circuit including a motor circuit selectively connecting said drive motors to said control power supply, an automatic cut-off circuit for automatically disconnecting said motor circuit from said control power supply and a timer circuit responsive to actuation a selected confirmation switch means for energizing said automatic cut-off circuit to disconnect said motor circuit from said control power supply upon termination of a predetermined time when said control switch means is not actuated or fails to operate within said predetermined time.

14. An electrically-operated article storage device as claimed in claim 13 wherein said control circuit further comprises a current detecting circuit responsive to variations in motor current to energize said automatic cut-off circuit to disconnect said motor circuit from said control power supply.

15. An electrically-operated article storage device as claimed in claim 12 which further comprises extensible connecting means extending between adjacent ones of said article storage units, and aisle formation detecting switch means associated with each said connecting means, said aisle formation detecting switch means being responsive to a predetermined spaced interval between adjacent article storage devices to energize said automatic cut-off circuit for disconnecting said motor circuit from said control power supply.

* * * * *

UNITED STATES PATENT OFFICE

CERTIFICATE OF CORRECTION

Patent No. 4,033,649 Dated July 5, 1977

Inventor(s) Han-Ichiro Naito et al.

It is certified that error appears in the above-identified patent and that said Letters Patent are hereby corrected as shown below:

Defining the second priority document: for "50-148665" read --49-148665--. Naming the second Attorney: for "Unqvarsky" read --Ungvarsky--. Column 1, line 20: between "of" and "narrow" read --a--. Column 2, line 18: for "electricaly" read --electrically--. Column 3, line 9: for "shos" read --shows--. Column 4, line 37: for "shiftable" read --shifting--; line 65: for "19a" read --19b--. Column 5, line 9: between "drive" and "33" read --motor--; line 45: for "at" read --to--; line 48: for "electromagntic" read --electromagnetic--. Column 6, line 38: for "73s" read --73s'--. Column 8, line 24: for "circut" read --circuit--; line 33: for "electromagntic" read --electromagnetic--; line 43: for "witch" read --switch--. Column 9, line 38: for "77c" read --77s--. Column 10, line 49: for "stock" read --stack--; line 53: between "simple" and "circuitry" read --in--; line 59: for "disconnect" read --disconnected--. Column 12, line 19: for "existed in" read --existing is--. Column 13, line 18: for "103s'" read --103s--. Column 22, line 9 (Claim 13, line 9): between "actuation" and "a" read --of--.

Signed and Sealed this

*Twentieth* Day of *December 1977*

[SEAL]

*Attest:*

RUTH C. MASON
*Attesting Officer*

LUTRELLE F. PARKER
*Acting Commissioner of Patents and Trademarks*